United States Patent [19]

Ferronniere et al.

[11] Patent Number: 4,545,319

[45] Date of Patent: Oct. 8, 1985

[54] PNEUMATIC BOATS OF THE INFLATABLE-DEFLATABLE TYPE

[75] Inventors: Michel Ferronniere, Paris; Yves Cros, Asnieres, both of France

[73] Assignee: Zodiac, Saint-Cloud, France

[21] Appl. No.: 185,938

[22] Filed: Sep. 10, 1980

Related U.S. Application Data

[63] Continuation of Ser. No. 927,395, Jul. 24, 1978, abandoned.

[51] Int. Cl.[4] ..... B63B 7/00

[52] U.S. Cl. ..... 114/345; 441/40

[58] Field of Search ..... 9/2 A, 2 R, 11 R, 11 A, 9/13; 114/123, 348, 345; 441/35–42

[56] References Cited

U.S. PATENT DOCUMENTS

| | | | |
|---|---|---|---|
| 1,419,464 | 6/1922 | Meyer | 9/2 A |
| 2,399,494 | 4/1946 | Manson et al. | 9/2 A |
| 2,508,304 | 5/1950 | Sturtevant | 9/2 A |

FOREIGN PATENT DOCUMENTS

| | | | |
|---|---|---|---|
| 966587 | 9/1957 | Fed. Rep. of Germany | 9/2 A |
| 1182979 | 12/1964 | Fed. Rep. of Germany | 441/35 |
| 1096077 | 6/1955 | France | 441/40 |
| 1380674 | 10/1964 | France | 9/11 A |
| 1290864 | 9/1972 | United Kingdom | 9/2 A |
| 1319072 | 5/1973 | United Kingdom | 9/2 A |

*Primary Examiner*—Trygve M. Blix
*Assistant Examiner*—Jesûs D. Sotelo
*Attorney, Agent, or Firm*—Peter K. Kontler

[57] ABSTRACT

The invention relates to a pneumatic boat of the inflatable-deflatable type capable of being propelled by a motor and comprising at least one inflatable member forming two parallel or substantially parallel arms joined at the front to form a stem-post and a rear board connecting these two arms and intended to receive or to house at least one motor, the two arms having, at least in their parallel or substantially parallel portions, a multi-lobe shaped cross section whose large axis slopes. The boat is characterized by the fact that a lateral canvas is fixed tangentially to at least some of the lobes on the outer side of the respective arm and by the fact that the slope of the large axis of the arm, the relative size of the lobes of this arm and the number of these lobes are such that the mean angle formed by this lateral canvas and the horizontal plane is between 5° and 45°.

19 Claims, 11 Drawing Figures

PNEUMATIC BOATS OF THE INFLATABLE-DEFLATABLE TYPE

This is a continuation of application Ser. No. 927,395, filed July 24, 1978, now abandoned.

BACKGROUND OF THE INVENTION

The invention relates to pneumatic boats of the inflatable-deflatable type, capable of being propelled by motor: such boats comprise at least one inflatable member forming two parallel or substantially parallel arms which join up towards the front to form a stem-post, and a rear board which connects these two arms and may be equipped with at least one motor.

This motor may be added to the rear board or incorporated therewith.

By pneumatic boat of the inflatable-deflatable type is meant boats which may be presented in a navigating condition (inflated boat) or in a transporting condition or storing condition (deflated boat) as opposed to some types of boats which constitute flexible structures made rigid by inflation.

Up to the present, boats of this kind were provided with a floor having rigidity, at least in the transverse direction, a bottom canvas fixed on the lower part of the inflatable member and a rigid or inflatable keel interposed between this floor and this bottom canvas so as to give to the latter a "V" cross-section conferring on the boat its qualities of navigability (rapid lift, stability, speed).

Generally, when it is desired to propel such boats with more than 10 hp, it is necessary to arrange the floor so that it has, besides its rigidity in the transverse direction, rigidity in the longitudinal direction for transmitting the thrust exerted on the rear board by the motor(s) of the boat.

In practically all cases, the floor of these boats is formed from several elements which have rigidity in the transverse direction and must be joined by appropriate means so as to obtain rigidity in the longitudinal direction.

The result is therefore a boat having the disadvantage of relatively complicated and time-consuming assembly, which runs counter to the pneumatic character of the boat. Moreover, the floor accounts for a large part, of the order of 30% to 40%, of the weight of the boat because of the mechanical characteristics which the component elements of this floor and their assembling means must have in the longitudinal direction.

SUMMARY OF THE INVENTION

The invention aims to remove the disadvantages due to complicated and time-consuming assembly.

The invention also has as an object a boat which is much lighter than the boats of the kind described above.

The invention further has as an object a boat whose assembly, from a folded position, may be automatically carried out by simple inflation of the inflatable member.

According to a first arrangement of the invention, the boat comprises at least one inflatable member forming two parallel or substantially parallel arms joined at the front to form a stem-post and a rear board connecting these two arms and intended to receive or house at least one motor, the two arms having, at least in their parallel or substantially parallel portion, a multi-lobe shaped cross section whose large axis slopes. The boat is characterized by the fact that a lateral canvas is secured tangentially to at least some of the lobes on the outer side of the respective arm and by the fact that the slope of the large axis of the arm, the relative size of the lobes of this arm and the number of these lobes are such that the mean angle formed by this lateral canvas and the horizontal plane is between 5° to 45°.

With this arrangement, the rigid floor, the bottom canvas and the keel may be eliminated.

This simplification of the boat is made possible because of the dual role of the multi-lobe section of the arms of the member. In fact, this sectional shape makes it possible, on the one hand, to obtain an arm having a higher moment of inertia and capable of resisting vertical forces and, on the other hand, to obtain a bearing surface having a cross-section which is in the form of a truncated V and confers on the boat qualities of navigability as good as a conventional "V" shaped bearing surface.

It will be readily understood that the assembly of such a boat is simplified and shortened.

It will also be understood that the weight of the boat is greatly reduced.

It will be further understood that it is possible to obtain automatic assembly, by simple inflation of an inflatable member, from a folded up position of the boat.

Preferably, each arm of the inflatable member of the boat has two lobes.

A two-lobe cross section may be advantageously obtained from two compartments of circular or substantially circular cross-section secured to one another along a circumferential zone.

The upper compartment may then have a section greater than that of the lower compartment.

There will be now set forth another arrangement of the invention which, although advantageously applied in combination with the first arrangement, may also be applied independently.

According to this arrangement, the boat comprises at least one inflatable member forming two parallel or substantially parallel arms joined towards the front to form a stem-post and a rear board connecting these two arms and intended to receive or to house at least one motor. The boat is characterized by the fact that this inflatable member comprises, at its stem-post, at least one keel fixed under its lower part.

If a single keel is provided, it is disposed along the longitudinal axis of the boat.

If several keels are provided, they are disposed symmetrically in relation to the longitudinal axis of the boat.

A keel fixed under the lower part of the member and having a length which does not substantially exceed the size of the member at the stem-post enable the part of the boat between the two arms to be freely arranged at will, without the need for a rigid floor and for a bottom canvas stretched by a longitudinal keel interposed between this floor and this bottom canvas.

It will be readily understood that the assembly of such a boat is simplified and shortened.

It will also be appreciated that the weight of the boat is greatly reduced.

It will be further appreciated that it is possible to obtain automatic assembly, by simple inflation of the inflatable member, from a folded up position of the boat.

Preferably, the height of the keel is a minimum at the front end of the stem-post and a maximum at the rear end of the stem-post. The keel may have a "V" shape in cross section.

The invention consists, apart from the arrangements which have just been discussed, of certain other arrangements which are preferably used at the same time and which will be more explicitly discussed hereafter.

The invention will be readily understood with the help of the following description as well as the accompanying drawings which describe and illustrate a preferred embodiment of the invention and are, of course, not limiting.

DETAILED DESCRIPTION OF THE DRAWINGS

Figure 1:
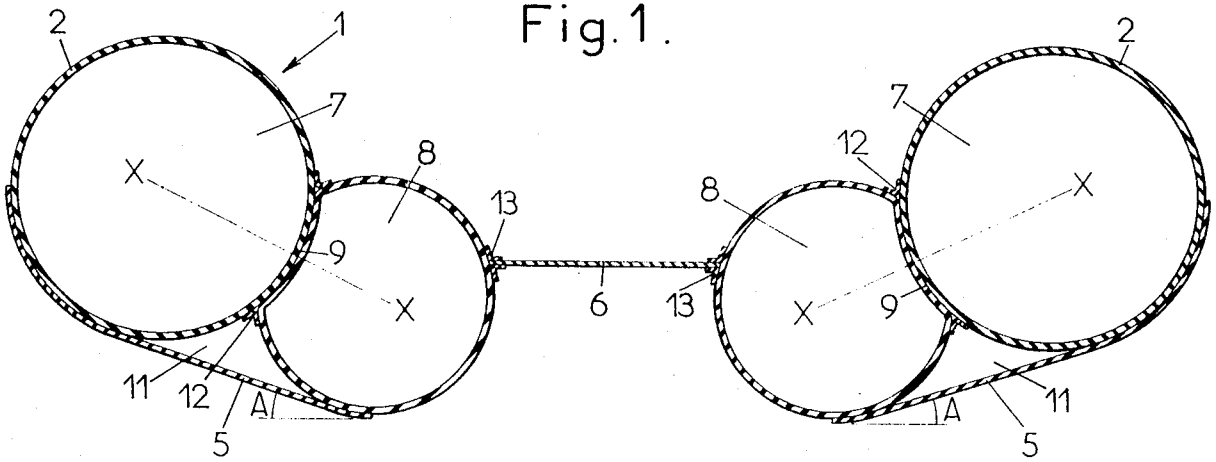
FIG. 1 of these drawings shows a cross-section of a boat according to the invention, the cross-section being taken in the middle part of the boat.

In these figures, there is shown a pneumatic boat comprising an inflatable member which is designated generally by the reference numeral 1 and has, a U shape as viewed from the top: this inflatable member 1 forms two parallel or substantially parallel arms 2 which are joined at the front to form a stem-post 3 and which are connected by a rear board 4 intended to be equipped with at least one motor.

Figure 3:
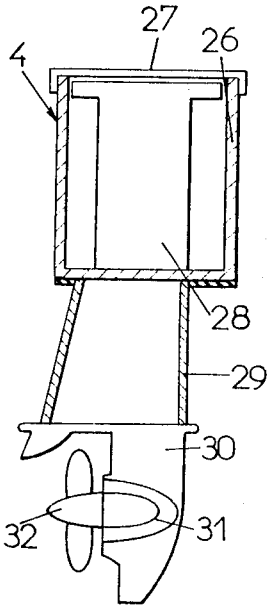
FIG. 3 is a section along line III—III of FIG. 2.
Figure 2:
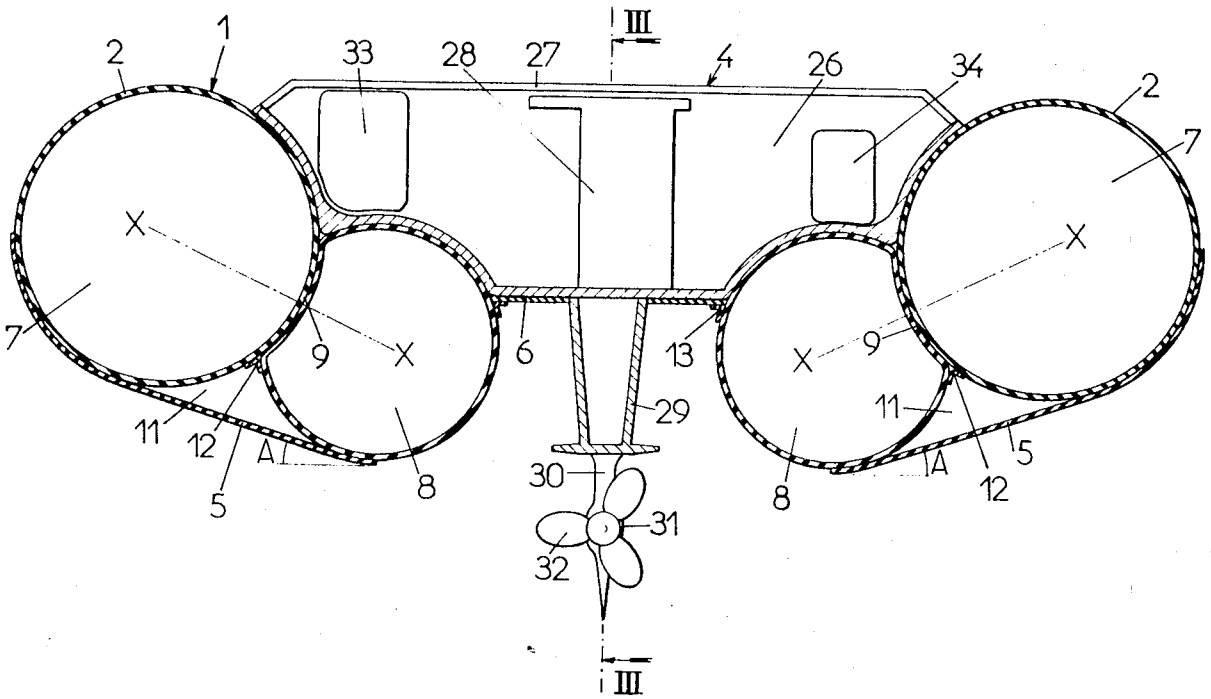
FIG. 2 shows a cross-section of a boat according to the invention, the cross-section being taken in the rear part of the boat.

The motor may be an outboard motor (which is not shown in the drawings) or a motor incorporated in the rear board 4 (as shown in FIGS. 2 and 3) which will be more explicitly discussed hereafter.

According to a first arrangement of the invention, clearly illustrated in FIGS. 1, 2, 4, 9, 10 and 11, each of the two arms 2 of the inflatable member 1 has, in cross-section, a multi-lobe shape whose large axis XX slopes.

A lateral canvas 5 is secured tangentially to the lobes on the outer side of each arm 2.

The slope of the large axis XX of each arm, the relative size of the lobes of the arm and the number of these lobes are such that the mean angle A formed by this lateral canvas 5 and the horizontal plane is between 5° and 45°, when the boat has zero trim.

As already mentioned, this arrangement allows the rigid floor, the bottom canvas and the keel in conventional pneumatic boats to be eliminated.

For supporting the occupants of the boat in accordance with the present invention, it is advantageous to provide a bottom 6 which may be formed by a canvas connecting the internal lobes of the inflatable member 1. The bottom 6 could also be formed by a grating placed on the internal lobes of the inflatable member 1.

The bottom 6 is clearly shown in FIGS. 1, 4, 9, 10 and 11.

The inflatable member 1 is concerned, it has advantageously has a dual lobe shape which may be obtained from two compartments 7,8 having a circular cross-section and secured to one another along a circumferential zone 9. As shown in FIG. 1, the large axis XX passes through the approximate centers of the circular cross-sections.

The upper compartment 7 may have a section greater than that of the lower compartment 8.

In the embodiment shown in FIGS. 1, 2, 4, 9, 10 and 11, the lower compartment 8 terminates at the rear, i.e. at the end of arms 2, in two cones 10.

Angle A formed by the lateral canvas 5 and the horizontal plane is 20°, the boat having zero trim.

Generally, it is advantageous for this angle to be between 5° and 25° for pneumatic boats of a length from 2 m to 6 m and capable of supporting a motor of 10 to 100 hp.

The inflatable member 1 is formed by joining the two compartments over the entire extent thereof, i.e. over the extent of the two arms 2 and the stem-post 3.

The bottom 6 may be formed, as mentioned previously, by a canvas connecting the arms of the inner lower compartment 8. This canvas may be fixed to the closest neighboring portions of this lower internal compartment 8 and may also be fixed to the part forming the stem-post of the compartment. The canvas is advantageously secured at the top of this part so as to rise towards the front of the boat, as clearly shown in FIG. 11. With such an assembly, bottom 6 is practically never in contact with the water, neither when the boat is stopped, nor when the boat is moving.

Whatever the form adopted for the multi-lobe construction of the inflatable member 1, there exists between the lobes and the lateral canvas, at least one compartment 11.

The compartment 11 may be permanently open, e.g. at its ends, and it is then occupied by water and/or air according to the trim of the boat.

The compartment 11 may also be closed and be provided with opening means (not shown), in which case it may be partially or totally filled with water at will to serve as a ballast.

The compartment 11 may be sealed and filled with air; it then serves as a buoyancy tank for the boat.

The compartment 11 may further be sealed and provided with inflation means (not shown) which, depending on the inflation pressure, allows the shape of lateral canvas 5 to be modified by giving it a more or less pronounced bulge capable of modifying the boat, particularly in turns.

From the constructional point of view, it should be pointed out that the joining of the two compartments 7 and 8, along the circumferential zone 9 may be effected by a bond reinforced at its ends with bonded corner pieces 12.

For fixing bottom 6 to the closest neighboring portions of the lower internal compartment 8, bonded angle pieces 13 may be used.

As for the lateral canvas 5, it is advantageously bonded to the two compartments 7 and 8.

According to another arrangement of the invention, which will first be assumed to be applied independently of the first arrangement discussed up to now and which is clearly illustrated in FIGS. 5, 6, 7 and 8, the inflatable member 1 comprises, at its stem-post 3, at least one keel 15 which is fixed under the lower part of the stem-post 3.

If a single keel 15 is provided, it is disposed along the longitudinal axis of the boat.

If several keels are provided (an embodiment not shown), they are disposed symmetrically in relation to the longitudinal axis of the boat.

The boat may then comprise a bottom 16 arranged in any appropriate manner and formed, for example by a canvas.

The keel 15 has a length substantially equal to the size of the member 1 at stem-post 3.

Figure 5:
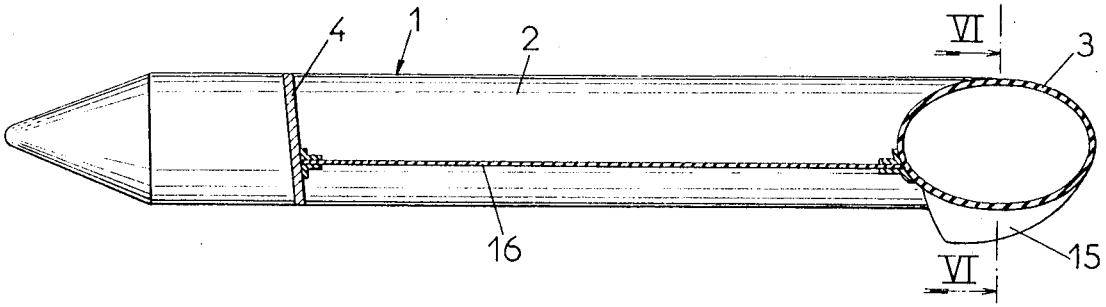
FIG. 5 shows a longitudinal section of a boat according to the invention.

The height of the keel 15 varies, as shown in FIG. 5, from a minimum value at the front end of stem-post 3 to a maximum value at the rear end of stem-post 3.

The keel 15 has a "V" shape in cross section.

Figure 6:
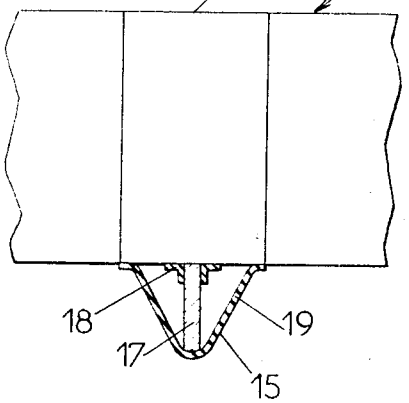
FIG. 6 is a section along line VI—VI of FIG. 5.

As shown in FIG. 6, the keel 15 may be formed by a thin vertical element 17 fixed on stem-post 3, e.g. by bonded angle pieces 18, the thin element 17 being covered with a canvas 19 fixed to the stem-post 3 on each side of the thin element 17.

Figure 7:
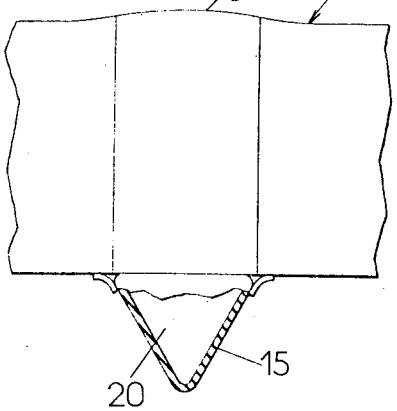

As shown in FIG. 7, the keel 15 could further be formed by an inflated extension 20 of member 1 at stem-post 3, this extension 20 having, the shape of a triangle in cross section.

Figure 8:
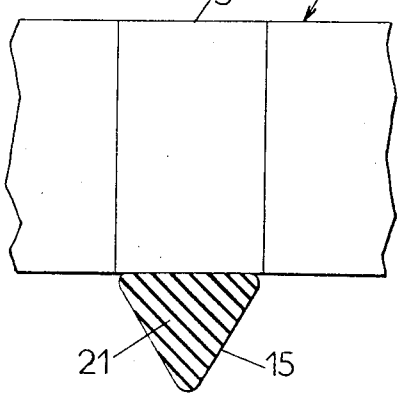
FIGS. 7 and 8 illustrate two ways of constructing the part of the boat shown in FIG. 6.

The keel 15 could also be formed, as shown in FIG. 8, by a solid body 21 in the shape of a triangle whose base is fixed to stem-post 3. This solid body 21 may be formed from a light plastic material.

Figure 4:
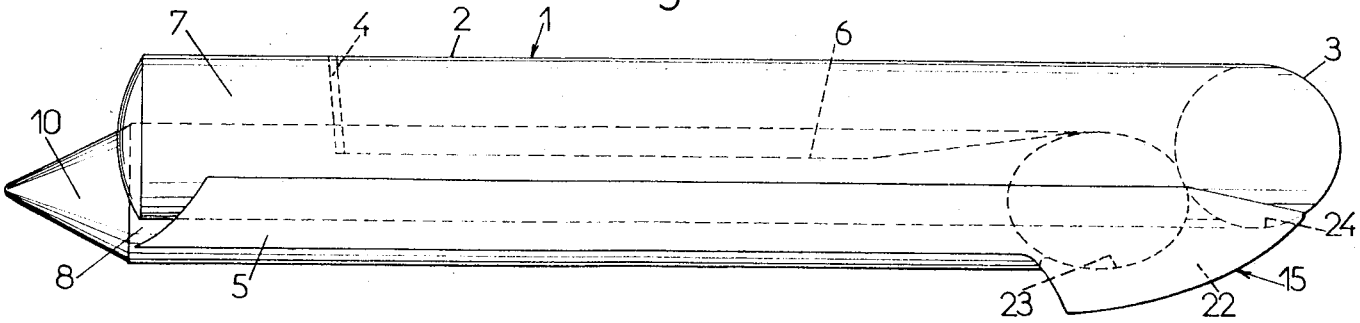
FIG. 4 is an elevational view of a boat according to the invention.
Figure 9:
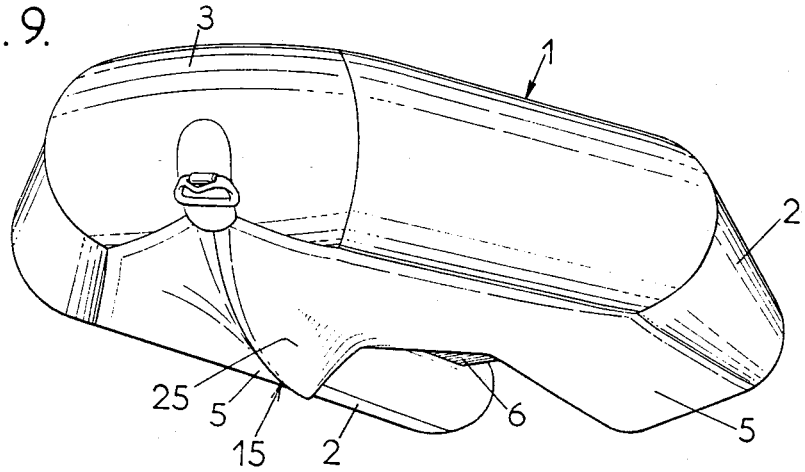
FIG. 9 is a perspective view of a boat according to the invention in an upside down position.
Figure 10:
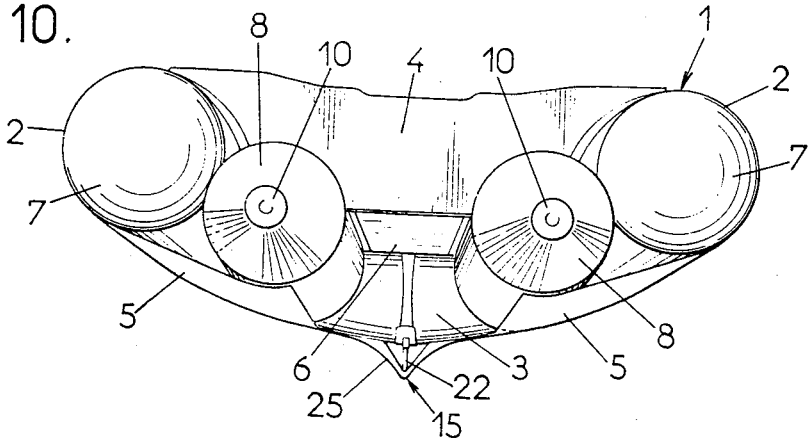
FIG. 10 is an end view of a boat according to the invention.
Figure 11:
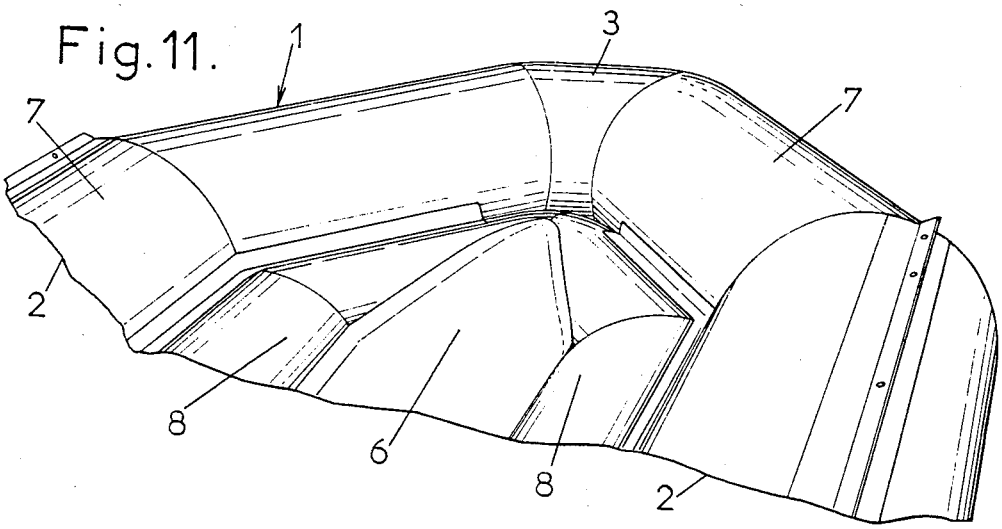
FIG. 11 is a top view of the front part of a boat according to the invention.

As shown in FIGS. 4, 9 and 10, the arrangement of the invention, including the keel 15 may advantageously be applied in combination with the arrangement including the lateral canvas 5.

As clearly shown in FIG. 4, keel 15 is then fixed to the lower part of stem-post 3 formed by the two compartments 7 and 8. The keel 15 has the same height characteristics and cross sectional shape as above.

As shown in FIGS. 4 and 10, the keel 15 is formed by a thin vertical element 22 fixed to stem-post 3, this element having cut-outs 23 and 24 required for mating the dual-lobe shape of the two compartments 7 and 8 forming the inflatable member 1. The thin element 22 is covered by a canvas 25 secured to the stem-post 3 on each side of the thin element 22. This canvas 25 may be advantageously formed by an extension of lateral canvas 5.

There will be now described in more detail with reference to FIGS. 2 and 3 an embodiment of a boat according to the invention in which the motor is incorporated in the rear board 4.

The rear board is, in this case, formed by a sealed box 26 provided, at its upper part, with a sealing cover 27.

The sealed box 26 houses a driving head 28 formed, for example, by an engine block of an internal combustion engine.

The sealed box 26 is extended downwards by a shaped piece 29 serving as a support for a base 30 comprising a propeller case 31 and a propeller 32, the base 30 being mounted for swivelling (under the action of appropriate control means, not shown) in relation to shaped part 29.

The sealed box 26 may also house a fuel reservoir 33.

Finally, an automatic inflation device 34 may also be housed in sealed box 26.

All embodiments provide a pneumatic boat which has a number of advantages including those summed up by the following points:

- simplified and shortened assembly of the boat since it may be carried out by simple inflation,
- reduced weight of the boat, particularly because of the absence of a rigid floor,
- possibility of obtaining automatic assembly by simple inflation from a folded up position,
- possibility of taking full advantage of the pneumatic character of the boat since inflation and deflation may be carried out very easily and very rapidly,
- possibility of constructing lifeboats which open automatically and may be motor driven,
- possibility of constructing pneumatic boats whose assembly may be effected in the water,
- possibility of constructing pneumatic boats which can be brought rapidly into service, automatically or not, owing to the incorporation of the drive in the rear board.

As is evident and follows from what has been said before, the invention is in no wise limited to the modes of application and the embodiments which have been described and illustrated but embraces, on the contrary, all variations thereof.

We claim:

1. A pneumatic boat, comprising an inflatable member having two arms which extend along the sides of the boat and are connected to each other in the region of the front of the boat, each of said arms including a pair of elongated inflatable components which are joined to one another along at least a part of their respective lengths, and each of said arms further including a sheet-like element on the outer side thereof affixed to and extending between the respective components and defining an acute angle with the horizontal, said arms defining a gap with one another; a bridging member mounted on said arms and bridging said gap, said bridging member being arranged at a level such that said bridging member is normally clear of a body of water on which the boat floats during both movement and stoppage of the boat, and said bridging member and said arms defining a space bounded by said bridging member from above and having a substantially unobstructed lower side and normally partly filled with water during flotation of the boat; a keel in the region of the front of the boat; and a transverse member interconnecting said arms in the region of the rear of the boat and adapted to carry motor means for propelling the boat.

2. The boat of claim 1, wherein said angle is between about 5 and 45 degrees.

3. The boat of claim 2, wherein said angle is between 5 and 25 degrees.

4. The boat of claim 1, wherein said sheet-like elements are substantially tangential to the respective components.

5. The boat of claim 1, wherein said inflatable member comprises a stem element connecting said arms to one another in the front of the boat.

6. The boat of claim 1, wherein said sheet-like elements comprise canvas.

7. The boat of claim 1, wherein said components of each of said arms are joined to one another along the circumferential surfaces thereof.

8. The boat of claim 1, wherein a line connecting the centers of said components of each of said arms makes an acute angle with the horizontal.

9. The boat of claim 1, wherein said components have substantially circular cross-sections.

10. The boat of claim 1, wherein the said components of each of said arms include an outer component and an inner component.

11. The boat of claim 10, wherein the inner component of each of said arms has a substantially conical free end portion at the rear of the boat.

12. The boat of claim 10, wherein the dimensions of the outer component of each of said arms exceed the dimensions of the respective inner component.

13. The boat of claim 10, wherein said bridging member is mounted on said inner components.

14. The boat of claim 1, wherein said keel extends downwardly from said inflatable member to a depth which increases in a direction from the front toward the rear of the boat.

15. The boat of claim 1, wherein said keel has a substantially V-shaped cross-sectional outline.

16. The boat of claim 1, wherein said keel includes a relatively thin supporting element extending at right angles to said inflatable member, and a cover affixed to and extending between said supporting element and said inflatable member.

17. The boat of claim 16, wherein said cover constitutes an extension of said sheet-like elements.

18. A pneumatic boat, comprising an inflatable member having two arms which extend along the sides of the boat and are connected to each other in the region of the front of the boat, each of said arms including a pair of elongated inflatable components which are joined to one another along at least a part of their respective lengths, and each of said arms further including a sheet-like element on the outer side thereof affixed to and extending between the respective components and defining an acute angle with the horizontal, said arms defining a gap with one another and said inflatable member further comprising a stem element connecting said arms to one another in the front of the boat, said stem element having a lower part; at least one keel affixed to the lower part of said stem element; a bridging member mounted on said arms and bridging said gap, said bridging member being arranged at a level such that said bridging member is normally clear of a body of water on which the boat floats during movement and stoppage of the boat, and said bridging member and said arms defining a space bounded by said bridging member from above and having a substantially unobstructed lower side and normally partly filled with water during flotation of the boat; and a transverse member interconnecting said arms in the region of the rear of the boat and adapted to carry motor means for propelling the boat.

19. The boat of claim 18, wherein the length of said keel at least approximates the front-to-rear dimension of said inflatable member at said stem element.

* * * * *